United States Patent [19]

Esmieu

[11] Patent Number: 4,597,277

[45] Date of Patent: Jul. 1, 1986

[54] PROCESS AND APPARATUS FOR PRODUCING REINFORCED METAL STRIPS

[75] Inventor: Jean-Paul Esmieu, Coulommiers, France

[73] Assignee: Cegedur Societe de Transformation de l'Aluminium Pechiney, Paris, France

[21] Appl. No.: 653,562

[22] Filed: Sep. 24, 1984

[30] Foreign Application Priority Data

Oct. 10, 1983 [FR] France ..... 83 16315

[51] Int. Cl.[4] ..... B21H 8/02; B21B 39/08

[52] U.S. Cl. ..... 72/182; 29/121.1; 29/121.5; 72/183; 72/199; 72/366

[58] Field of Search ..... 72/182, 183, 176, 177, 72/366, 199, 179, 180; 29/121.5, 121.6, 110, 121.1

[56] References Cited

U.S. PATENT DOCUMENTS

| | | | |
|---|---|---|---|
| 2,193,231 | 3/1940 | Gibbons | 72/179 |
| 2,586,011 | 2/1952 | Doelter | 29/121.6 X |
| 3,022,231 | 2/1962 | Broderick | 29/121.5 X |
| 4,433,565 | 2/1984 | Preller | 72/177 |

FOREIGN PATENT DOCUMENTS

| | | | |
|---|---|---|---|
| 0094975 | 3/1939 | Sweden | 29/121.1 |

*Primary Examiner*—Francis S. Husar
*Assistant Examiner*—Steve Katz
*Attorney, Agent, or Firm*—Dennison, Meserole, Pollack & Scheiner

[57] ABSTRACT

Metal sheets of aluminum are provided with raised reinforcing portions of substantial height by rolling. The rolls have recesses or channels (6) whose side faces are in a counter-taper configuration with respect to a plane perpendicular to the axis of the cylinder, with an angle of inclination ($\alpha$) of up to 5°. The resulting product may advantageously be used for producing perforated metal sheets with high modulus of inertia.

7 Claims, 7 Drawing Figures

PROCESS AND APPARATUS FOR PRODUCING REINFORCED METAL STRIPS

BACKGROUND OF THE INVENTION

The present invention concerns a process for producing metal strips provided with raised reinforcing portions of substantial height, by rolling, and the apparatus for carrying out the process, that is to say, the corresponding rolls of suitable shape.

For the economic production of boarding and planking or bridge flooring, it has long been known to use metal sheets whose moment of inertia is reinforced by ribs. For that purpose, panel elements of aluminum of a plate configuration which are reinforced on one face by longitudinal ribs are currently produced by an extrusion process. Extrusion is even used to produce box elements of closed section in the direction of the extrusion process. However, extrusion is still a process which involves certain disadvantages.

A process involving rolling between rolls comprising hollowed-out channels or patterns is currently used to produce strips of aluminum comprising corresponding patterns of a raised configuration, which strips can then be cut up into metal sheets of the desired format. However, the above-mentioned patterns such as those on teardrop-type metal sheets are of small thickness, of the order of a millimeter. They have a decorative or non-slip effect but they have virtually no influence on the bending strength of the metal sheets or plates.

In order to facilitate the movement of the rolled metal into the cavities in the roll, to avoid incipient rupture at the base of the raised patterns on the metal sheet, the recesses in the roll connect to the surface of the roll without a sharp angle, in most cases by way of a rounded or at least chamfered or bevelled surface. Generally, in the prior art, the side faces of the recesses in the roll are inclined surfaces which converge towards the bottom of the recess and which are not perpendicular to the surface of the roll.

In another respect, calculation shows that, in order to produce patterns of substantial thickness on the strip, it is desirable to have a substantial coefficient of friction between the metal and the roll, and also a substantial reduction in the thickness of the metal on respective sides of the pattern. Those are difficult and burdensome conditions in regard to the rolling operation. Now, it has been found that, if it was not desirable to have sharp edges at the junction between the surface of the roll and the surface of the recesses but, in accordance with the prior art, such junction rather comprises rounded or at least chamfered connecting portions, it was in contrast undesirable, contrary to the generally accepted ideas, for the inclined convergent surfaces to be continued to the bottom of the recesses (normal taper or relief). In fact, the metal which goes to fill the recesses in the roll is retarded in its lateral displacement by friction against the inclined surfaces of the recesses. It was found that much better results are obtained by providing the rolls with recesses in which, except for the mouth opening thereof, the side surfaces are perpendicular to the axis of the roll or even inclined in a 'counter-taper configuration', that is to say, recesses with a dovetail section which increases in width towards the bottom of the recess. As the metal penetrates into such recesses, it is no longer retarded by frictional engagement against the side wall surfaces of the recesses. However, the outward flare of the recesses towards the bottom thereof may only be slight. The 'counter-taper' inclination ($\alpha$) of the side wall surfaces with respect to the lines perpendicular to the axis of the roll must be limited to an angle of the order of 5°, in order to limit the possible expansion of the metal which is urged into the recesses and to permit the patterns which are formed in a raised configuration on the strip to be removed from the recesses in the roll without too much difficulty in the subsequent stage. The above-mentioned form of the recesses in the rolling rolls, being flared slightly towards the bottom of the recesses, has been found to be a particularly attractive proposition for producing metal sheets or plates which are longitudinally ribbed in the direction of rolling, in which case the recesses are then in the form of circular channels or passes.

Obviously, the high ribs, which have parallel side faces, stick strongly in the recesses or channels in the roll. That phenomenon is further accentuated when the recesses or channels in the roll have side faces of 'counter-taper' type which produce in the strip ribs of dovetail cross-section, in the axial plane of the rolls.

On issuing from the roll, a substantial pulling force has to be applied to the strip in order to detach it from the roll and to prevent it from being wound round on to the roll. The head portion of the ribs or at least the central portion thereof if the material has not filled the entire volume of the roll grooves is, as it were, rolled laterally when they leave the reduced exit orifice of the channels in the roll. Contrary to what might have been thought, there is no tearing or wrenching of a rib, nor even incipient rupture at the root of the ribs, provided obviously that the counter-taper inclination of the side faces of the channels in the roll is slight, that is to say, of the order of 5% with respect to planes that are perpendicular to the axis of the roll. The pulling force to be applied to the rolled strip in order to detach it from the channel-bearing roll, if it is expressed with respect to the cross-section of the strip, may be greater than 40 $N/mm^2$. For aluminum and alloys thereof, it is generally of the order of 40 to 50 $N/mm^2$.

However, having regard to the power levels available on present-day cold rolling mills, the raised portions of substantial height can be produced only on relatively soft metals or alloys which are sufficiently ductile in the cold condition; aluminum alloys in the annealed state or similar states, in respect of which the eleastic limit is lower than or equal to 200 MPa, are particularly suitable for the process according to the invention. In another respect, certain geometrical conditions are required in regard to filling the recesses in the roll, the depth (p) thereof being generally greater than their width (1), and they must be separated by a distance (d) which is between 0.5L and 3L. Below 0.5L, the mechanical strength of the land between two channels or passes becomes insufficient; above a value of 3L, the channels are not sufficiently filled by the metal.

It is preferable that the overall rolling effect imposed on the strip, as measured by $$\frac{S-s}{S} \times 100,$$

wherein S is the initial cross-section and s is the final cross-section of the product, is high, being generally greater than 60.

SUMMARY OF THE INVENTION

The process according to the invention therefore comprises machining at least in one of the rolls, recesses or channels in accordance with the foregoing description and setting it or them in position, introducing a strip whose thickness is such that the overall rolling or working effect is greater than 60% with a slight clamping effect (P) in respect of the rolls, fixing the strip on to the winding machine and applying a certain pulling force (F), progressively and simultaneously increasing the speed, the clamping effect (P) and the pulling force (F) so as to produce the desired metal sheet thickness (e).

It was thus possible to produce metal sheets comprising tall ribs, that is to say, metal sheets provided with longitudinal ribs whose height (h) is more than twice the thickness (e) of the metal plate portion joining them together at their base. The above-mentioned height (h) may easily be five times the thickness (e) of the metal plate portion joining the ribs together.

For example, with ribs whose height (h) is equal to their spacing (d), that is to say, whose pitch is of the order of double their height, the saving in weight, with an equal modulus of inertia in the longitudinal direction, is of the order of half with respect to a solid metal sheet of the same nature and the same total thickness.

The above-indicated rolling method is applied also to composite strips wherein the metal core portion is covered at least by a metal surface layer (such as brazing, cathodic protection or the like) or even to composites of metal and plastics materials.

Joining two ribbed metal sheets or strips which are produced in that way, by any known means (brazing, adhesive means, etc.) makes it possible to produce structures which are resistant to forces in two axes when the ribs are crossed (not parallel).

The invention will be better appreciated from the following description of a particular embodiment and from study of the corresponding drawings.

DESCRIPTION OF THE PREFERRED EMBODIMENTS

Figure 1:
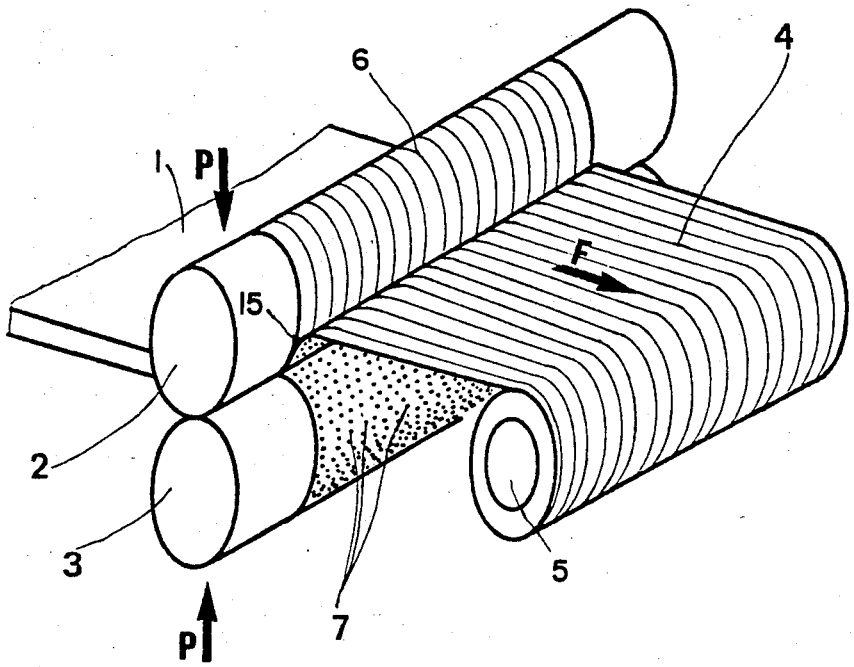
FIG. 1 is a perspective view of a rolling installation constructed in accordance with the invention.
Figure 3:
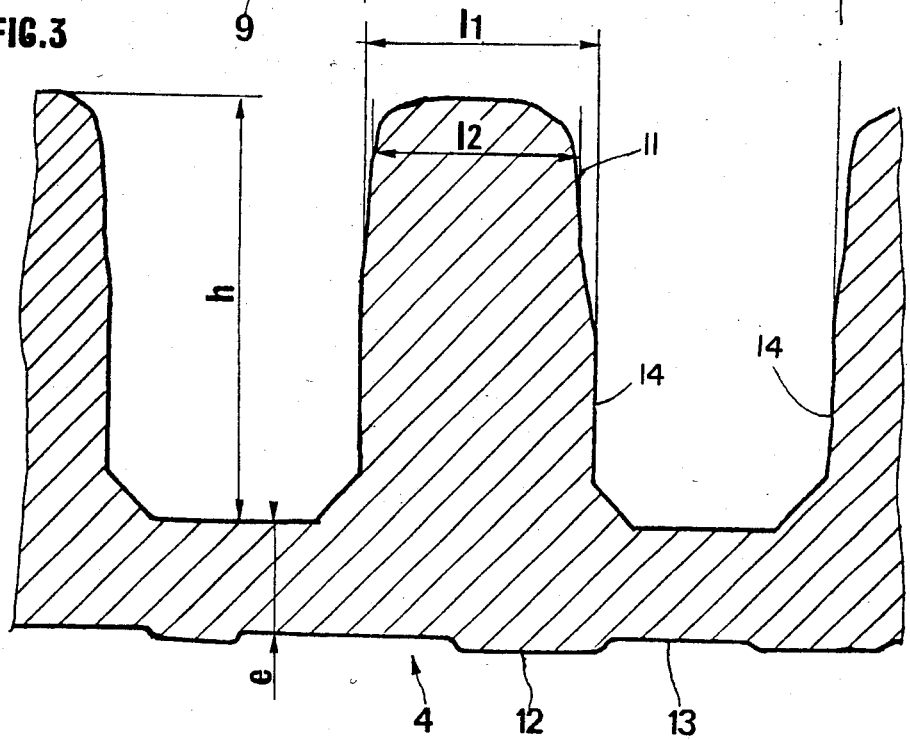
FIG. 3 is a view on the same scale of a portion of aluminum strip produced in accordance with the invention, the cross-sectional plane being perpendicular to the ribs of the strip.

Referring to FIG. 1, shown therein is a flat strip 1 which is 12 mm in thickness and 950 mm in width, of annealed quality 3003 aluminum, which is rolled between two rolls 2 and 3 to give a strip 4 whose cross-section is shown in FIG. 3. On issuing from the rolls, the strip 4 is wound on to a winding machine 5 which applies a pulling force F of the order of 200,000 N. The clamping force P between the two rolls 2 and 3 is of the order of 7,000,000 N, that is to say, with respect to the width of the metal sheet of the order of 7,000 N/mm.

Figure 2:
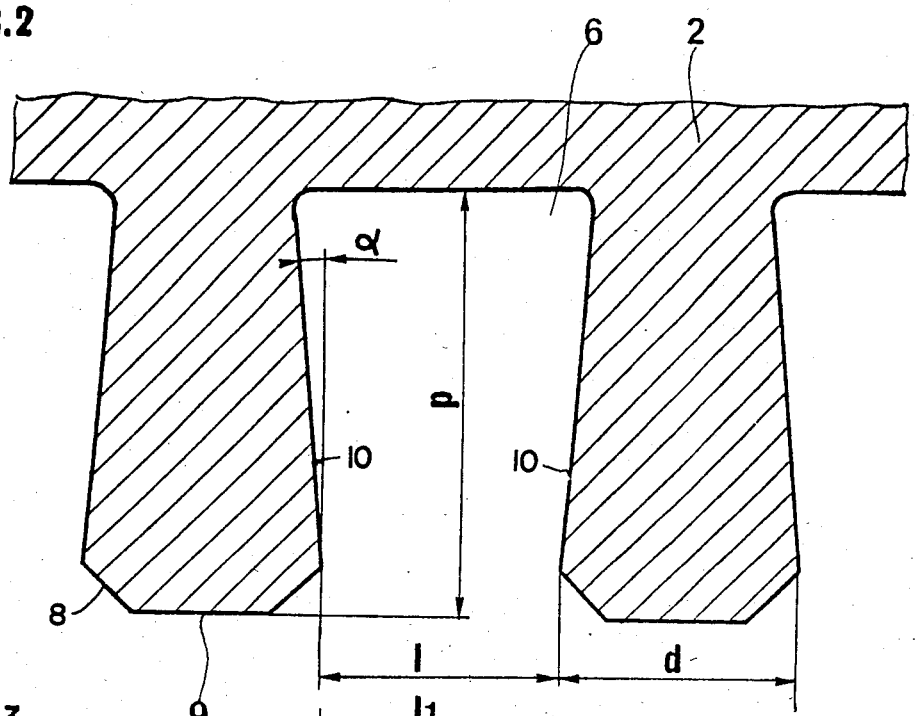
FIG. 2 is a view on a larger scale and in cross-section of a portion of the grooves surface of the rolling roll.

The roll 2 comprises a series of parallel peripheral channels or passes 6 whose section is shown in FIG. 2 while the roll 3 comprises, in accordance with the prior art, a series of hollow patterns 7 of small depth, which are regularly disposed on the surface thereof.

It will be seen from FIG. 2 that, if the channels or passes 6 of the roll are connected laterally by way of chamfered surfaces 8 to the cylindrical envelope surface 9 of the roll 2, the channels 6 have divergent side faces 10 of a 'counter-taper' configuration, whereby the width of the channels 6 is larger at the bottom thereof than at the periphery of the roll 2. The outward flare of the channels 6 in the direction towards the bottom thereof is very slight. The angle $\alpha$ of the generation of the side faces 10, to the lines perpendicular to the axis of the roll (or the axial plane of the channel) is only 5°. The depth p of the channels is 7 mm and the width $l_1$ thereof is 4 mm at their narrowest part, at the periphery of the cylinder 2. They are spaced by 4 mm (distance d).

It will be seen from FIG. 3 that, on one face, the ribbed strip 4 comprises ribs 11 of a height h that is substantially equal to the depth p of the channels 6, of a width $l_1$ that is substantially equal to the width 1 of the channels 6, in their narrowest part, and of a pitch p equal to the pitch of the channels 6. On its other face, the strip 4 comprises raised portions 12 of small thickness, being 0.2 mm in this case, corresponding to the patterns 7 on the roll 3. The portions 12 correspond to the prior art.

Finally, in its thinnest part, constituting the thin plate portion 13 forming the connections between the ribs 11, the thickness e of the strip 4 is only 1.8 mm.

In the course of the rolling operation, the metal of the strip 1, that is displaced by the peripheral surface of the roll 2, penetrates substantially to the bottom of the channels 6 in the roll 2 to form ribs 11. The metal has spread out in the channels 6 which are wider at the bottom than at the mouth opening, without, however, completely filling them, as can be seen by virtue of the width $l_2$ of the ribs 11 at their upper ends. The above-mentioned width $l_2$ is slightly less than the width $l_1$ of the channels 6 at their mouth opening. In this particular case, $l_1 = 3.8$ mm. It is only at the base of the ribs 11 that they are of their greatest width $l_1$ and are delimited by parallel faces 14. In the course of the rolling operation, the metal of the strip 1 was displaced by the pressure applied by the outside surface 9 of the roll, into the channels 6. The metal spread out in the channels 6, following their divergent faces 10, to a position substantially at the mid-height level of the grooves 6, before being 'drawn out' on issuing from the groove.

On issuing from the rolls 2, 3, the divergent base portions of the ribs 11, beig trapped in the channels 6 with their couter-taper configuration, retain the strip 4 pressed against the roll 2. The strip 4 would become wound around the roll if it were not drawn by the winding machine 5 with a force F of the order of 200,000 N. It will thus be noted from FIG. 1 that, on issuing from the rolls 2 and 3, the strip 4 forms a portion 15 which is slightly bent around against the roll 2. The force F which permits the metal sheet 4 to be extracted gives rise to a kind of lateral rolling action in respect of the base of the ribs 11. Provided that it is not excessive and does not give rise to incipient rupture phenomena at the base of the ribs 11, the above-mentioned lateral rolling action in respect of the ribs makes it possible to achieve the large rib heights required and is found to be beneficial by compressing the metal.

In the case of aluminum or alloys thereof, with rolls 2 with deeper channels, a pressure P between the rolls 2 and 3, which is greater than 7,000 N/mm of metal sheet width, and a pulling force of greater than 40 N/mm$^2$ of metal sheet section, it is readily possible to produce taller ribs, for example ribs which are of a height h of the order of 10 mm, for a plate thickness as indicated by e, of the order of 2 mm.

It is possible to use the rolled metal sheets with the tall ribs as described hereinbefore to produce perforated ribbed metal sheets in the form of thick grills which are fairly similar in appearance to grills which are made of 'expanded metal'. However, such grills have much greater mechanical strength by virtue of their being reinforced by their tall ribs. In fact, the tall ribs of the initial metal sheet are retained and are only deformed in a zig-zag configuration. They constitute a very strong frame structure.

Figure 4:
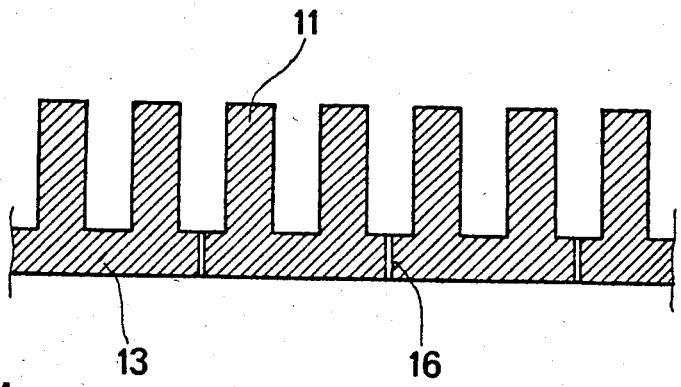
FIG. 4 is a view in cross-section taken along line A—A′ (in FIG. 5) of a metal sheet having high ribs wherein the plate portion between the ribs has been perforated by slots which are equally spaced from the ribs.
Figure 5:
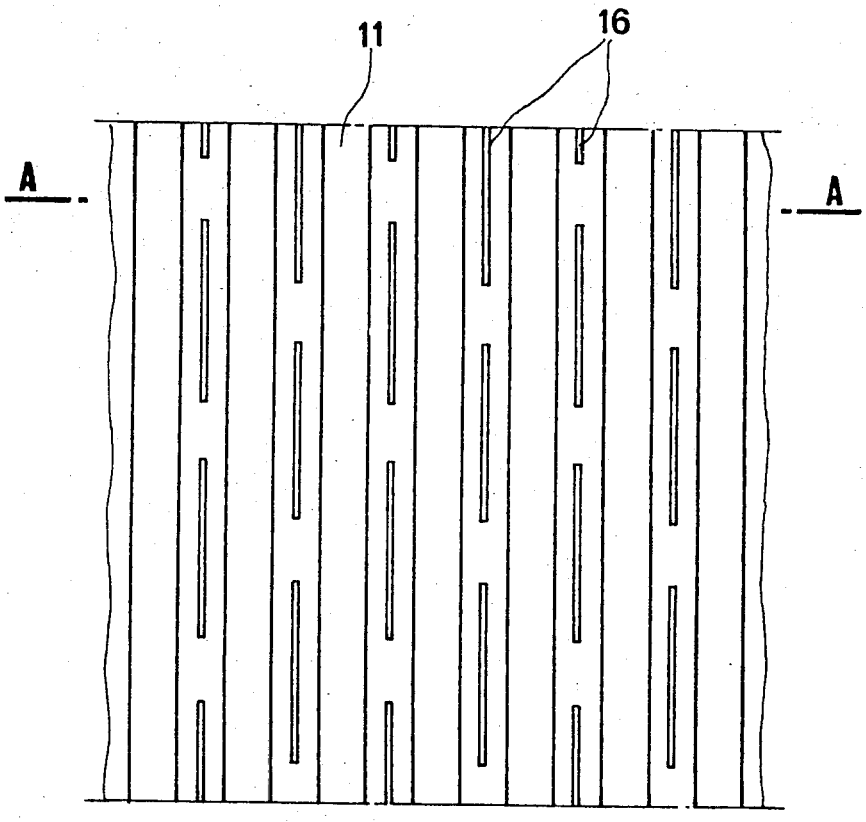
FIG. 5 shows a plan view of the metal sheet of FIG. 4.

To produce perforated metal sheets of that kind, in the form of ribbed grills, the procedure involves beginning by forming perforations, by known means, in the thin parts of the metal sheet 4, that is to say, in the thin plate portion 13. As shown in FIGS. 4 and 5, the perforations 16 are made in the form of parallel slots which are equally spaced from the ribs 11 in each of the gaps between the ribs 11. As can be seen from FIG. 5, the slots are disposed in a mutually staggered arrangement in a horizontal plane. The middle of each slot 16 is disposed at the level of a nonperforated part of the portion 13 between two adjacent ribs 11.

Figure 6:
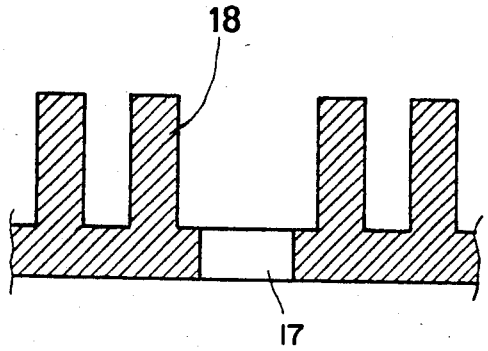
FIG. 6 is a view in cross-section taken along line B—B′ in FIG. 7, of the metal sheet shown in FIGS. 4 and 5 in which the slots have been increased in width by applying a lateral pulling force to the metal sheet.
Figure 7:
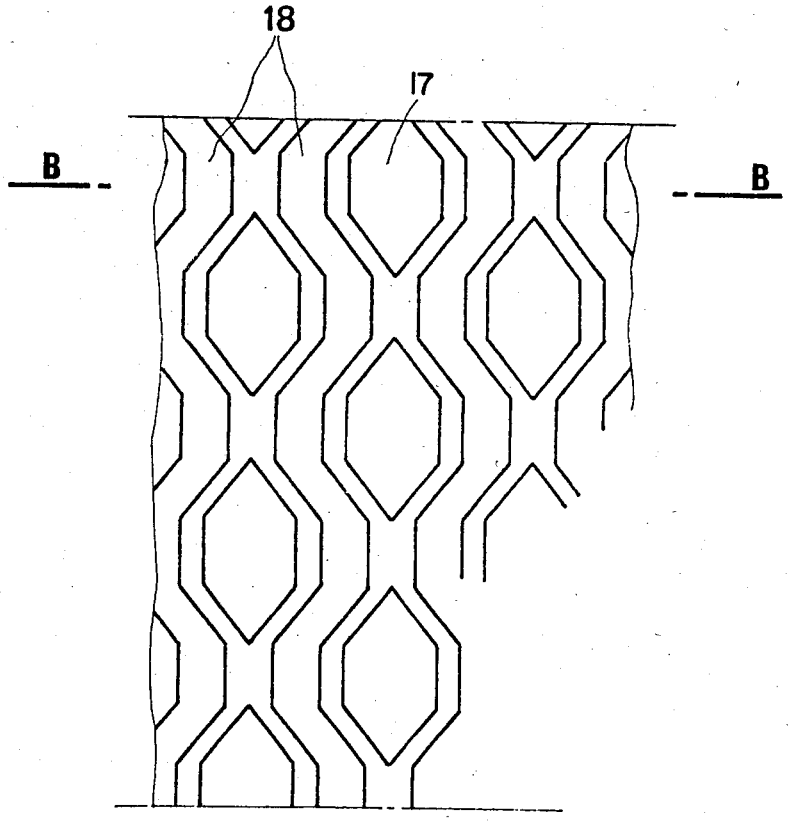
FIG. 7 shows a plan view of the metal sheet of FIG. 6.

A lateral pulling force is then applied to the metal sheet. The slots 16 increase in width in the form of substantially hexagonal holes 17, as shown in FIGS. 6 and 7. At the same time, the ribs 11 are deformed into a zig-zag configuration as shown at 18. The tall and relatively wide ribs impart a high degree of rigidity to the perforated metal sheet which is of a honeycomb appearance.

In the embodiment described, the slots are all of the same length, but it would also be possible to produce perforated, ribbed metal sheets with slots of different lengths. However, for good performance of the process, it is important for the slots to be disclosed in a regular configuration in a mutually staggered arrangement in a horizontal plane.

In the embodiment described, the roll 3 comprises small hollow patterns 7 which produce the raised portions 12. The roll 3 could equally well be smooth or in contrast could comprise deep channels similar to the channels 6 in the roll 2. With a channeled roll 3, a metal sheet 4 with ribs 11 on the two faces thereof would be produced.

What is claimed is:

1. A process for cold rolling metal strips of aluminum or alloys thereof comprising, the steps of:

(a) providing at least one roll comprising an envelope surface and a plurality of circumferential recesses in said surface spaced axially along said roll and defined by two side walls and a bottom wall, each said recess having a depth at least equal to its width, said recesses being spaced by a distance between 0.5 and 3 times said width, wherein said recesses have a dovetail configuration in axial cross-section, said side walls diverging in the direction toward said bottom wall;

(b) introducing a strip of thickness such that the overall rolling effect $$\frac{S-s}{S}$$

wherein S is the initial strip cross-section and s is the final cross-section is greater than 0.6, with a clamping action (P) between said roll and a second roll;

(c) applying an initial pulling force, to said strip; and (d) progressively increasing the speed and the pressure of said rolls while increasing the pulling force applied to the strip, so as to produce the desired metal sheet thickness.

2. A process according to claim 1, wherein the initial pulling force is greater than 40 N/mm$^2$ of final cross-section of the strip.

3. Method according to claim 1, wherein said clamping action is greater than about 7,000 N/mm of sheet width.

4. A cold rolling mill roll for producing strips or metal sheets having raised portions, said roll comprising an envelope surface and a plurality of circumferential recesses in said surface spaced axially along said roll and defined by two side walls and a bottom wall, each said recess having a depth at least equal to its width, said recesses being spaced by a distance between 0.5 and 3 times said width, wherein said recesses have a dovetail configuration in axial cross-section, said side walls diverging in the direction toward said bottom wall.

5. A roll according to claim 4, wherein the angle ($\alpha$) of inclination of the side walls of the recesses, to a plane perpendicular to the axis of the roll is about 5° or less.

6. A rolling mill roll according to claim 4, wherein the recesses of dovetail configuration are connected to the envelope surface of the roll by rounded or at least chamfered edge portions.

7. An apparatus for producing strips or metal sheets having raised portions, comprising:

(a) a cold rolling mill roll comprising an envelope surface and a plurality of circumferential recesses in said surface spaced axially along said roll and defined by two side walls and a bottom wall, each said recess having a depth at least equal to its width, said recesses being spaced by a distance between 0.5 and 3 times said width, wherein said recesses have a dovetail configuration in axial cross-section, said side walls diverging in the direction toward said bottom wall;

(b) a second roll adjacent to and having an axis parallel to said mill roll;

(c) means moving said rolls towards each other to clamp a strip or sheet placed therebetween;

(d) means causing axial rotation of said rolls; and (e) means applying a pulling force to a strip or sheet placed between said rolls;

whereby the overall rolling effect $$\frac{S-s}{S}$$

on a strip or sheet of initial cross-section S and final cross-section s is greater than 6.0.

* * * * *